US007377088B2

(12) United States Patent
Buschmann et al.

(10) Patent No.: US 7,377,088 B2
(45) Date of Patent: May 27, 2008

(54) METHOD FOR PACKAGING A LIGHT BULB

(75) Inventors: Jeffrey P. Buschmann, Lexington, KY (US); James E. Oetken, Winchester, KY (US)

(73) Assignee: Osram Sylvania Inc, Danvers, MA (US)

( * ) Notice: Subject to any disclaimer, the term of this patent is extended or adjusted under 35 U.S.C. 154(b) by 0 days.

(21) Appl. No.: 11/799,853

(22) Filed: May 3, 2007

(65) Prior Publication Data

US 2007/0209329 A1 Sep. 13, 2007

Related U.S. Application Data

(62) Division of application No. 11/417,621, filed on May 4, 2006.

(60) Provisional application No. 60/696,656, filed on Jul. 5, 2005.

(51) Int. Cl.
*B65B 23/22* (2006.01)

(52) U.S. Cl. ..... 53/472; 53/49; 53/142; 206/418

(58) Field of Classification Search ..... 53/49, 53/472, 142; 206/418; *B65B 23/22*
See application file for complete search history.

(56) References Cited

U.S. PATENT DOCUMENTS 1,710,543 A * 4/1929 Leo ..... 206/418
3,247,954 A * 4/1966 Liberman ..... 206/422
4,162,008 A * 7/1979 McCalmont ..... 206/418
4,724,871 A * 2/1988 Griffin ..... 206/418
4,759,167 A * 7/1988 Langen et al. ..... 53/142
5,775,530 A * 7/1998 Attaway ..... 220/4.22
7,000,775 B2 * 2/2006 Gelardi et al. ..... 206/776

FOREIGN PATENT DOCUMENTS

DE 8220999.3 * 12/1982

* cited by examiner

*Primary Examiner*—Stephen F Gerrity
(74) *Attorney, Agent, or Firm*—William H. McNeill

(57) ABSTRACT

A package (10) for a bulb (12) having a bulbous, light-emitting end (14) and a socket end (16), has a first thin-walled plastic body (18*a*) arrayed along a longitudinal axis (20) and having a closed end (22) and an open end (24), the open end (24) having a diameter D transverse to the longitudinal axis sufficient to admit insertion of the bulbous, light emitting end (14) of the bulb (12), the closed end (22) of the first thin-walled plastic body (18*a*) formed with at least one internal surface support (26) extending away from the longitudinal axis (20) in a plane transverse to the longitudinal axis and substantially contiguous with a curve of the bulbous light emitting end (14), the open end (24) providing a circumferential coupling area (28); and a second thin-walled plastic body (18*b*) formed with a socket receiving end (32) and a mating coupling area (34) formed to conform to the circumferential coupling area (28) and coupled thereto. The package is preferably made by a method of packaging a light bulb as described above wherein the method comprises the steps of: forming a hollow body (18) to receive the light bulb; separating the body (18) into a bottom portion (18*a*) and a top portion (18*b*); inserting a light bulb (12) into the bottom portion (18*a*); inverting the top portion (18*b*) and placing the top portion 918*b*) within the lower portion (18*a*) in a manner to grasp the socket end (16) of the light bulb (12); and sealing the top portion (18*b*_ to the bottom portion (18*a*) to form the package (10).

1 Claim, 4 Drawing Sheets

METHOD FOR PACKAGING A LIGHT BULB

CROSS-REFERENCE TO RELATED APPLICATION

This application is a divisional application of Ser. No. 11/417,621, filed May 4, 2006 and claims the benefit of Provisional Patent Application No. 60/696,656, filed Jul. 5, 2005.

TECHNICAL FIELD

The invention relates to packaging for electric lamps and particularly to plastic shell packaging. More particularly the invention is concerned with a tubular plastic shell for a bulbous electric lamp

BACKGROUND ART

Individual packages for common light bulbs, such as the 60, 75 and 100 watt bulbs used in households, often comprise a clear, plastic envelope that is rectangular in a front elevation and triangular in a side elevational. The construction is usually referred to as a "clam shell" package and can include descriptive literature within the package. While this form of packaging has worked well, it is relatively expensive and limited to single bulb packaging and it would be an advance in the art to provide a convenient and economical replacement package that was capable of standing on a shelf, hanging from a hook, provided multiple bulbs in a convenient package all the while protecting the enclosed fragile light bulb or bulbs during shipping and handling. It would be a further advance in the art to provide new, inexpensive methods for packaging these bulbs.

DISCLOSURE OF INVENTION

It is, therefore, an object of the invention to obviate the disadvantages of the prior art.

It is another object of the invention to enhance light bulb packaging.

It is a still further object of the invention to enhance packaging techniques.

These objects are accomplished, in one aspect of the invention, by a package for a bulb having a bulbous, light-emitting end and a socket end, said package comprising: a first thin-walled plastic body arrayed along a longitudinal axis and having a closed end and an open end, said open end having a diameter transverse to said longitudinal axis sufficient to admit insertion of said bulbous, light-emitting end of said bulb, said closed end of said first thin-walled plastic body formed with at least one internal surface support extending away from said longitudinal axis in a plane transverse to said longitudinal axis and substantially contiguous with a curve of said bulbous light-emitting end, said open end providing a circumferential coupling; and a second thin-walled plastic body formed with a socket receiving end and a mating coupling end formed to conform to said circumferential coupling and coupled thereto These objects are further accomplished, in another aspect of the invention, by a method of packaging a light bulb comprising the steps of: forming a hollow body to receive the light bulb; separating said body into a bottom portion and a top portion; inserting a light bulb into said bottom portion; inverting said top portion and placing said top portion within said lower portion in a manner to grasp an end of said light bulb; and sealing said top portion to said bottom portion.

The objects are still further accomplished by an alternate method of construction wherein there is provided a method of packaging a light bulb having a bulbous light-emitting end and a socket end, said method comprising the steps of: forming a first hollow body to receive said bulbous light-emitting end of said light bulb; forming a second hollow body to receive said socket end of said light bulb; placing said bulbous light-emitting end of said light bulb into said first hollow body; placing said second hollow body over said socket end of said light bulb; and sealing said first hollow body to said second hollow body to form a package,

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figures 1, 2, 3:
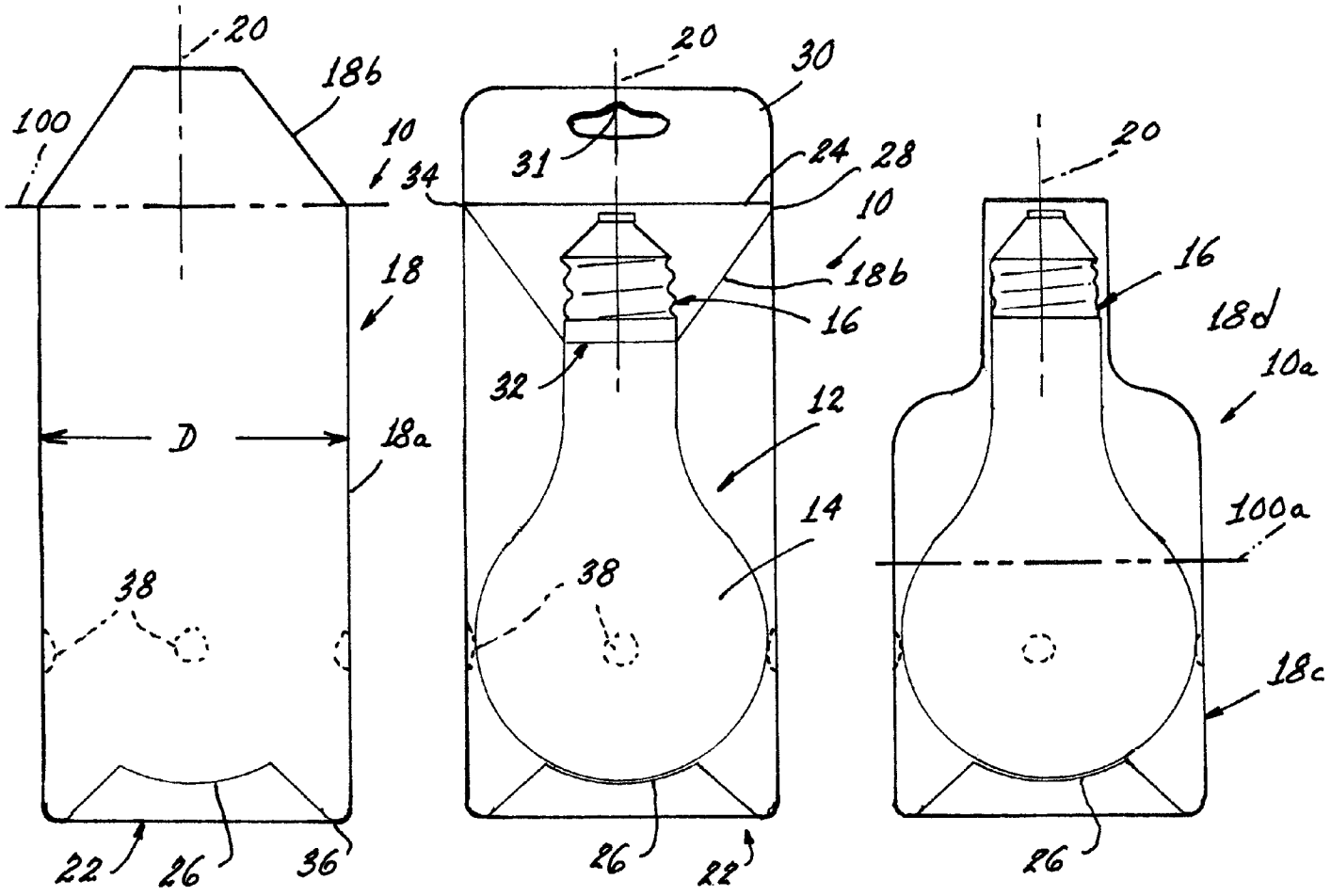
FIG. 1 is an elevational view an embodiment of the invention.
FIG. 2 is an elevational view of an assembled package in accordance with an aspect of the invention.
FIG. 3 is an elevational view of an assembled package in accordance with another aspect of the invention.
Figure 5:
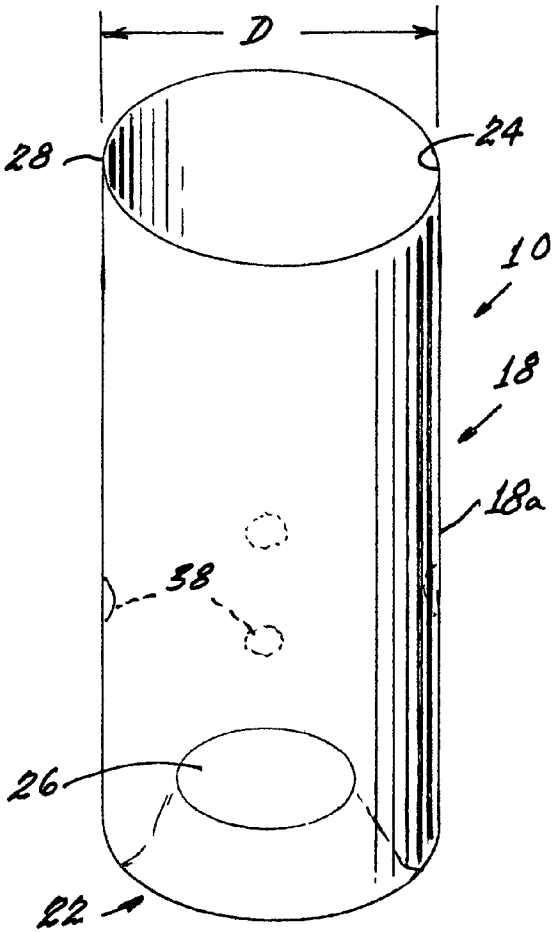
FIG. 5 is a perspective view of a second portion of a package.
Figure 4:
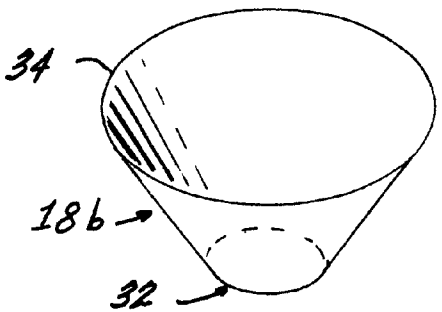
FIG. 4 is a perspective view of a portion of a package.

Referring now to the drawings with greater particularity, there is shown in FIG. 2 a package 10 for a bulb 12 having a bulbous, light-emitting end 14 and a socket end 16. The package 10 comprises a thin-walled plastic body 18 having a first portion 18*a* arrayed along a longitudinal axis 20 and having a closed end 22 and an open end 24. The open end 24 has a diameter D transverse to the longitudinal axis sufficient to admit insertion of the bulbous, light-emitting end 14 of the bulb 12. The closed end 22 of the first portion 18*a* is formed with at least one internal surface support 26 extending away from the longitudinal axis 20 in a plane transverse to the longitudinal axis and substantially contiguous with a curve of the bulbous light-emitting end 14. The open end 24 provides a circumferential coupling area 28. A second thin-walled plastic body 18*b* is formed with a socket receiving end 32 and a mating coupling area 34 formed to conform to the circumferential coupling area 28 and coupled thereto. The sealing areas are more clearly seen in FIGS. 4 and 5 and the sealing can be accomplished in any convenient manner, such as by ultrasonic welding, gluing, friction fitting, threading, etc.

A tab 30 can be provided in any of the embodiments shown to allow for the package 10 to be hung from a hook or peg via a mounting passage 31; however, to insure the availability of alternative positioning the closed end 22 of the first thin-walled plastic body 18*a* has an external surface 36 formed to allow the package 10 to stand upright.

In a preferred mode of assembling the package 10, a hollow body 18 is formed to receive the light bulb. The body

18 (shown in FIG. 1), preferably is formed by blow-molding in a manner similar to that employed in making water bottles and a preferred material is polyethylene terephthalate that is transparent and about 0.016" thick. After forming, the body 18 is separated into a bottom portion 18*a* and a top portion 18*b* by cutting along the line 100. A light bulb 12 is inserted into the bottom portion 18*a* and the top portion 18*b* is inverted and placed within the lower portion 18*a* in a manner to grasp the socket end 16 of the light bulb 12. That is, the socket receiving end 32 slips over the socket end 16 of the bulb 12 and the mating coupling area 34 engages the circumferential coupling area 28 and is sealed thereto by any of the techniques noted above to form the package 10.

An alternate method and alternate package 10 is depicted in FIG. 3 wherein the package 10*a* can be formed from bottom 18*c* and top 18*d*. This package also can be formed as a single unit and separated into the bottom and top portions by cutting along the line 100*a*. Assembly of the package would be similar to package 10, that is, a light bulb 12 would be inserted into the bottom portion 18*c*, the top portion 18*d* fitted over the socket end 16 and sealing of the two parts together. While it would of course be possible to manufacture the two parts of the package separately, it is believed that the methods shown herein are preferable from a cost and convenience standpoint.

Figure 7:
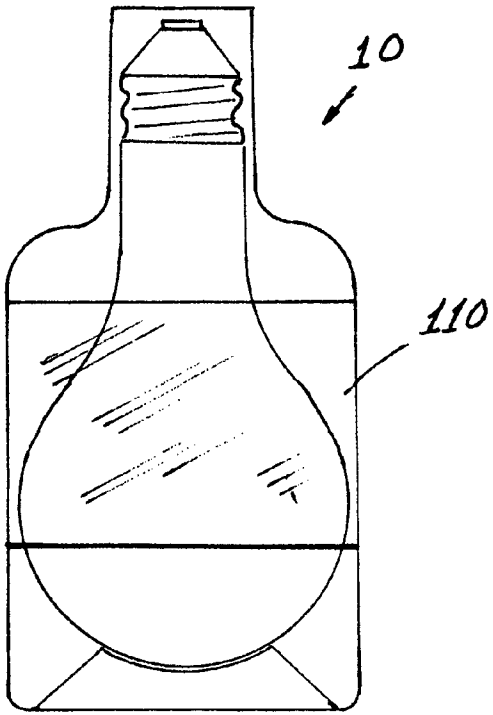
FIG. 7 is an elevational view of a bulb package with an indicia-supplying label.
Figure 6:
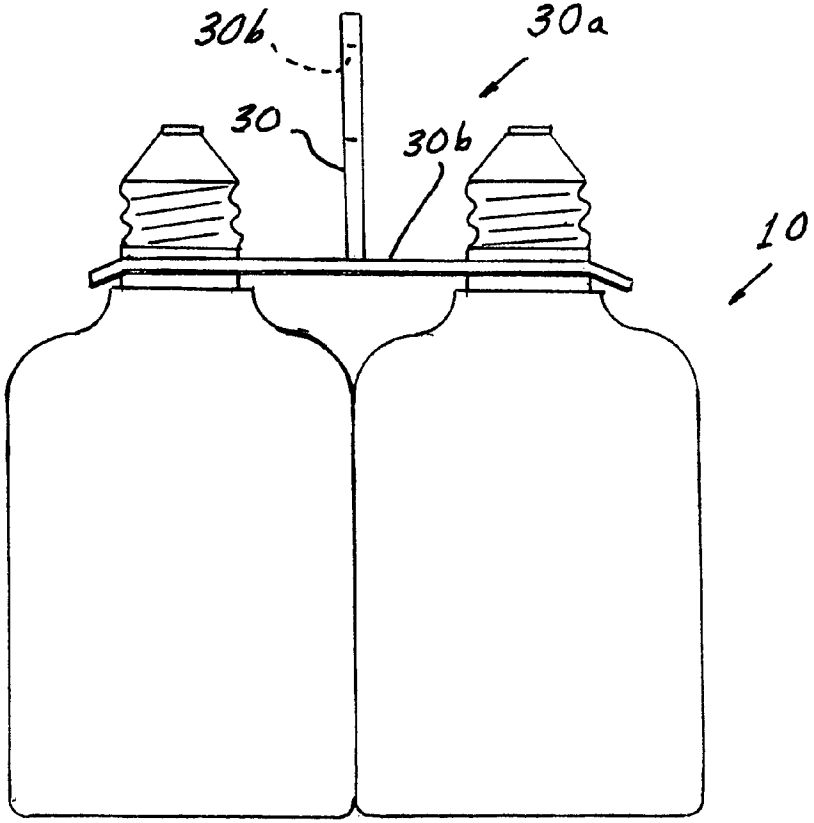
FIG. 6 is an end view of a multiple bulb package with a convenient carrying strap.
Figure 8:
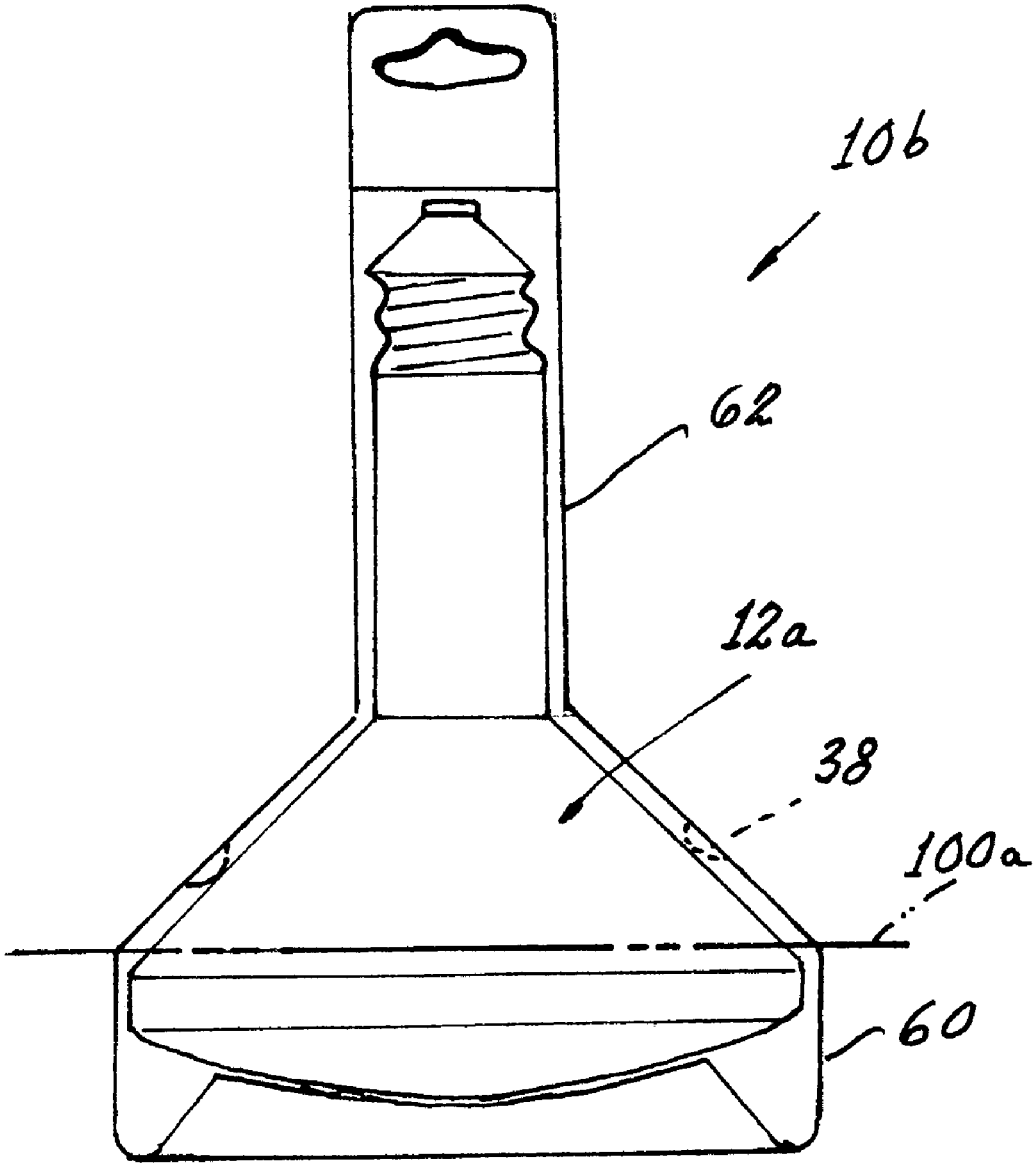
FIG. 8 is an elevational view of a bulb package for a PAR bulb.

The package is capable of varied applications as shown in FIGS. 6-8. FIG. 6 shows that multiple packages 10 can be combined into a unit by the addition of a carrying strap 30*a* that comprises a planar section 30*b* containing multiple friction apertures for engaging the bulb necks, as shown, or the upper portion of the package if the package (for example, the package shown in FIG. 3) extends to completely cover the neck and base of the bulb, and an upright section 30*c* containing a finger opening 30*d*. The carrying strap 30*a* can be formed to accommodate two, four, six or more bulbs.

The package 10 can also be supplied with a wrap-around indicia-carrying label 110 as shown in FIG. 7. The label can be transparent or opaque; however, transparent is preferred.

Further, the package is adaptable to bulb shapes other than the A-line shape. As shown in FIG. 8, a package 10*a* can easily be provided for a PAR bulb 12*a*. In the latter case, if the package 10*b* is formed in a single piece, a cut-line 100*a* can be provided to separate the package into a bottom section 60 and a top section 62. After the bulb is inserted into the bottom section 60 the top section 62 can be sealed thereto to complete the package.

In any of the embodiments disclosed either (or both) portion 18*a*, 18*b*, 18*c*, 18*d* or 60, 62 can be provided with indentations 38 to maintain the bulb 12 offset from the convex envelope of the package and to serve a centering function and provide cushioning during transportation.

While there have been shown and described what are at present considered to be the preferred embodiments of the invention, it will be apparent to those skilled in the art that various changes and modifications can be made herein without departing from the scope of the invention as defined by the appended claims.

The invention claimed is:

1. A method of packaging a light bulb comprising the steps of:

forming a hollow body to receive the light bulb, said body having an element at the upper end of said body to grasp the bulb;

separating said body into a bottom portion and a top portion wherein said element is at the upper end of said top portion;

inserting a light bulb into said bottom portion;

inverting said top portion so that said element is at the lower end of said top portion and placing said top portion within said bottom portion in a manner so that said element grasps an end of said light bulb; and sealing said top portion to said bottom portion.

* * * * *